US007575525B2

(12) United States Patent
Matsunaga et al.

(10) Patent No.: US 7,575,525 B2
(45) Date of Patent: Aug. 18, 2009

(54) GOLF CLUB HEAD

(75) Inventors: Hideo Matsunaga, Chichibu (JP); Makoto Kubota, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 9 days.

(21) Appl. No.: 11/927,943

(22) Filed: Oct. 30, 2007

(65) Prior Publication Data

US 2008/0153626 A1 Jun. 26, 2008

(30) Foreign Application Priority Data

Dec. 20, 2006 (JP) ..... 2006-343460

(51) Int. Cl.
*A63B 53/04* (2006.01)

(52) U.S. Cl. ..... 473/342; 473/345; 473/349; 473/350

(58) Field of Classification Search ..... 473/324–350
See application file for complete search history.

(56) References Cited

U.S. PATENT DOCUMENTS

| | | | | |
|---|---|---|---|---|
| 5,346,217 | A | 9/1994 | Tsuchiya et al. | |
| 5,362,047 | A * | 11/1994 | Shaw et al. | 473/291 |
| 5,366,223 | A * | 11/1994 | Werner et al. | 473/349 |
| 6,348,013 | B1 * | 2/2002 | Kosmatka | 473/329 |
| 6,506,129 | B2 * | 1/2003 | Chen | 473/329 |
| 6,508,722 | B1 * | 1/2003 | McCabe et al. | 473/330 |
| 6,565,452 | B2 * | 5/2003 | Helmstetter et al. | 473/342 |
| 6,595,871 | B2 | 7/2003 | Sano | |
| 6,663,501 | B2 * | 12/2003 | Chen | 473/324 |
| 6,669,576 | B1 * | 12/2003 | Rice | 473/305 |
| 6,695,712 | B1 * | 2/2004 | Iwata et al. | 473/291 |
| 6,832,961 | B2 * | 12/2004 | Sano | 473/324 |
| 6,841,014 | B2 * | 1/2005 | Huang et al. | 148/608 |
| 6,860,823 | B2 * | 3/2005 | Lee | 473/329 |
| 6,994,636 | B2 | 2/2006 | Hocknell et al. | |
| 7,029,403 | B2 * | 4/2006 | Rice et al. | 473/329 |
| 7,096,558 | B2 * | 8/2006 | Sano | 29/428 |
| 7,121,958 | B2 * | 10/2006 | Cheng et al. | 473/345 |
| 7,357,730 | B2 * | 4/2008 | Shieh | 473/342 |

(Continued)

FOREIGN PATENT DOCUMENTS

EP 1 364 683 A3 11/2005

(Continued)

*Primary Examiner*—Sebastiano Passaniti
(74) *Attorney, Agent, or Firm*—Sughrue Mion, PLLC

(57) ABSTRACT

The present invention provides a golf club head capable of lessening the decrease in carry even for an off-center hit. In a golf club head in which a face part 2 of a metallic head body 1 having a hollow part therein is formed with an opening 8 communicating with the hollow part, and a metallic face plate 9 is welded to the opening 8, notch parts 8A and 8B connecting with the opening 8 are formed in a part on the toe 6 side of a crown part 3 and a part on the heel 7 side of a sole part 4, respectively; and the upper end portion of the face plate 9 is extended so as to compensate the notch part 8A in the crown part 3 and welded to the notch part 8A, and the lower end portion thereof is extended so as to compensate the notch part 8B in the sole part 4 and welded to the notch part 8B.

8 Claims, 4 Drawing Sheets

U.S. PATENT DOCUMENTS

| | | | | |
|---|---|---|---|---|
| 7,367,899 | B2 * | 5/2008 | Rice et al. | 473/329 |
| 2001/0014629 | A1 * | 8/2001 | Anderson | 473/345 |
| 2003/0228933 | A1 | 12/2003 | Rice | |
| 2004/0138001 | A1 | 7/2004 | Sano | |
| 2005/0101407 | A1 | 5/2005 | Hirano | |
| 2006/0030424 | A1 | 2/2006 | Su | |
| 2006/0252576 | A1 | 11/2006 | Lo | |

FOREIGN PATENT DOCUMENTS

| | | | |
|---|---|---|---|
| GB | 2 412 072 | A | 9/2005 |
| JP | 09-215783 | A | 8/1997 |
| JP | 11-313906 | A | 11/1999 |
| JP | 11-347155 | A | 12/1999 |
| JP | 2000-350798 | A | 12/2000 |
| JP | 2001-062004 | A | 3/2001 |
| JP | 2003-052866 | A | 2/2003 |
| JP | 2003-265656 | A | 9/2003 |
| JP | 2004-065853 | A | 3/2004 |
| JP | 2006-166975 | A | 6/2006 |

* cited by examiner

GOLF CLUB HEAD

BACKGROUND OF THE INVENTION AND RELATED ART STATEMENT

1. Field of the Invention

The present invention relates to a metallic hollow golf club head and, more particularly, to a golf club head in which a face plate is welded to an opening formed in a face part.

2. Description of Related Art

As a conventional metallic hollow golf club head in which a face plate is welded, a golf club head as shown in FIG. 7 has been known. In this golf club head, a substantially rectangular opening 20 is formed in a face part 2 of a metallic head body 1 having a hollow part 10 therein, and a face plate 30 having a shape matching the opening 20 is laser welded to a receiving part 2B formed at the periphery of the opening 20. The head body 1 includes a crown part 3, a sole part 4, and a hosel 5 in addition to the face part 2, and has a toe 6 and a heel 7. In this conventional examples, the welding strength is improved, and therefore damage is less likely to occur (Japanese Unexamined Patent Application Publication No. 2004-65853 (p.4, FIG. 1)).

Also, as a golf club head in which the whole of face part is a member separate from the head body and this face part is welded to the head body, there has been known a golf club head in which the face part is deflected when the ball is hit by decreasing the thickness of the face part, thereby increasing carry. Due to the shape of the head body, such a face part is formed so that the length in the right and left direction (the toe-heel direction) is greater than the length in the up and down direction (the top-sole direction). Therefore, the deflection of the face part when the ball is hit is greater in the right and left direction than in the up and down direction, and the slope toward the center position at which the deflection is greatest is gentler in the right and left direction than in the up and down direction of the face. For this reason, when the ball is hit, the ball is not compressed while the ball cross section perpendicular to the hit direction (the ball compressing direction) is maintained in a circular shape. Uneven compression causes distortion of the circular cross-sectional shape, which makes it difficult to control the direction that the ball flies.

As a golf club head which, by preventing the occurrence of anisotropy, compresses a ball into an even shape and increases the rebounding force when the ball is hit, there has been known a golf club head in which an opening having almost the same lengths in the up and down direction and the right and left direction is formed in the face part, and a face plate having the same shape as that of the opening is welded to the opening (Japanese Unexamined Patent Application Publication No. 2003-265656 (p.2, FIG. 1)).

The conventional face plate has been developed assuming that a golfer hits a ball at the center of a face plate or the periphery thereof, that is, the sweet spot and therefore the conventional face plate does not sufficiently accommodate variations in hit points of general amateur golfers. The conventional example in Japanese Unexamined Patent Application Publication No. 2003-265656 has been invented from the viewpoints described below. The material of head is changed from stainless steel to titanium alloy in response to recent tendency. Along with the increase in size of the head, titanium alloy has a high strength in comparison with its low Young's modulus, which is about 60% of that of stainless steel, and therefore the thickness of the face surface is decreased to deflect the face surface when the ball is hit, by which the initial velocity (delivery velocity) of the ball is increased. However, when a ball is hit at a portion deviating from the sweet spot, especially at the face part such as a toe upper portion or a heel lower portion other than the substantially square-shaped face plate, the carry decreases extremely.

OBJECT AND SUMMARY OF THE INVENTION

The present invention has been made to solve the above problems, and accordingly an object thereof is to provide a metallic hollow golf club head in which a face plate is designed by giving consideration to the variations in hit points of general amateur golfers, so that the decrease in carry is less even for an off-center hit (hit deviating from the sweet spot).

To achieve the above object, the present invention provides a golf club head in which a face part of a metallic head body having a hollow part therein is formed with an opening communicating with the hollow part, and a metallic face plate is welded to the opening, wherein a notch part connecting with the opening is formed in a part on the toe side of a crown part and a part on the heel side of a sole part; and the upper end portion of the face plate is extended so as to compensate the notch part in the crown part and welded to the notch part, and the lower end portion thereof is extended so as to compensate the notch part in the sole part and welded to the notch part.

According to the present invention, in the golf club head in which the face part of the metallic head body having the hollow part therein is formed with the opening communicating with the hollow part, and the metallic face plate is welded to the opening, the notch part connecting with the opening is formed in a part on the toe side of the crown part and a part on the heel side of the sole part; and the upper end portion of the face plate is extended so as to compensate the notch part in the crown part and is welded to the notch part, and the lower end portion thereof is extended so as to compensate the notch part in the sole part and is welded to the notch part. Therefore, the shape of the face plate covers the distribution of hit points of general amateur golfers, so that even for an off-center hit, the decrease in carry becomes less.

DETAILED DESCRIPTION OF PREFERRED EMBODIMENTS

A preferred embodiment of the present invention will now be described with reference to the accompanying drawings.

Figure 1:
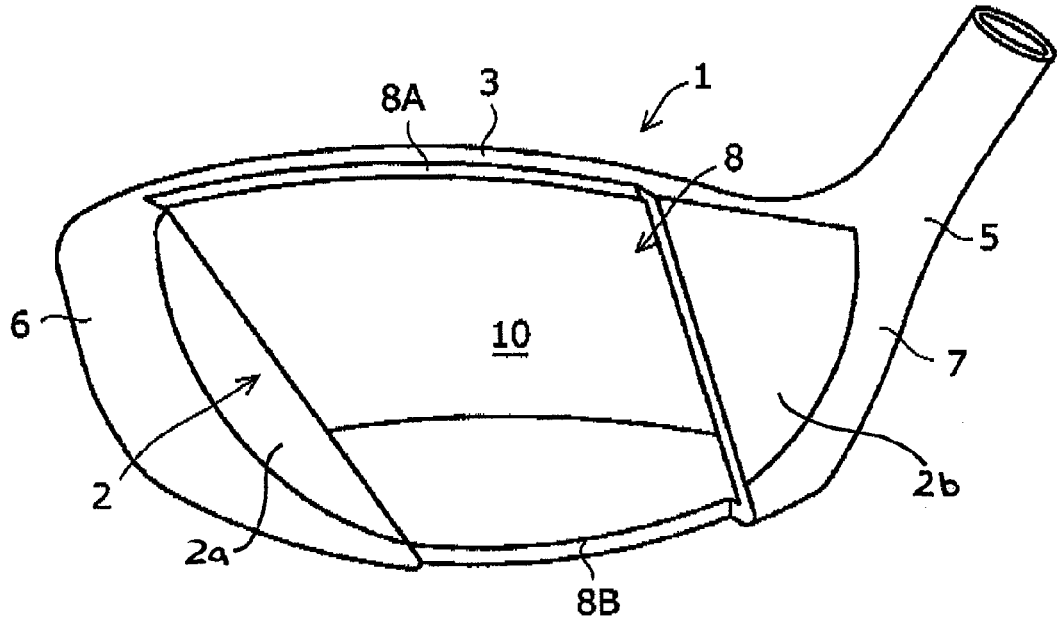
FIG. 1 is a perspective view of a golf club head before a face plate is welded.

In FIG. 1, a metallic head body 1 having a hollow part 10 therein is formed with an opening 8 communicating with the hollow part 10. As in the case of the conventional examples the head body 1 includes a face part 2, a crown part 3, a sole part 4, and a hosel 5, and has a toe 6 and a heel 7. Unlike the conventional example, the opening 8 does not have a square shape, but is formed into a rectangular shape such that the front shape tilts to the toe 6 side. Also, a face plate 9 welded to the opening 8 is also formed into a rectangular shape matching the shape of the opening 8.

Figure 2:
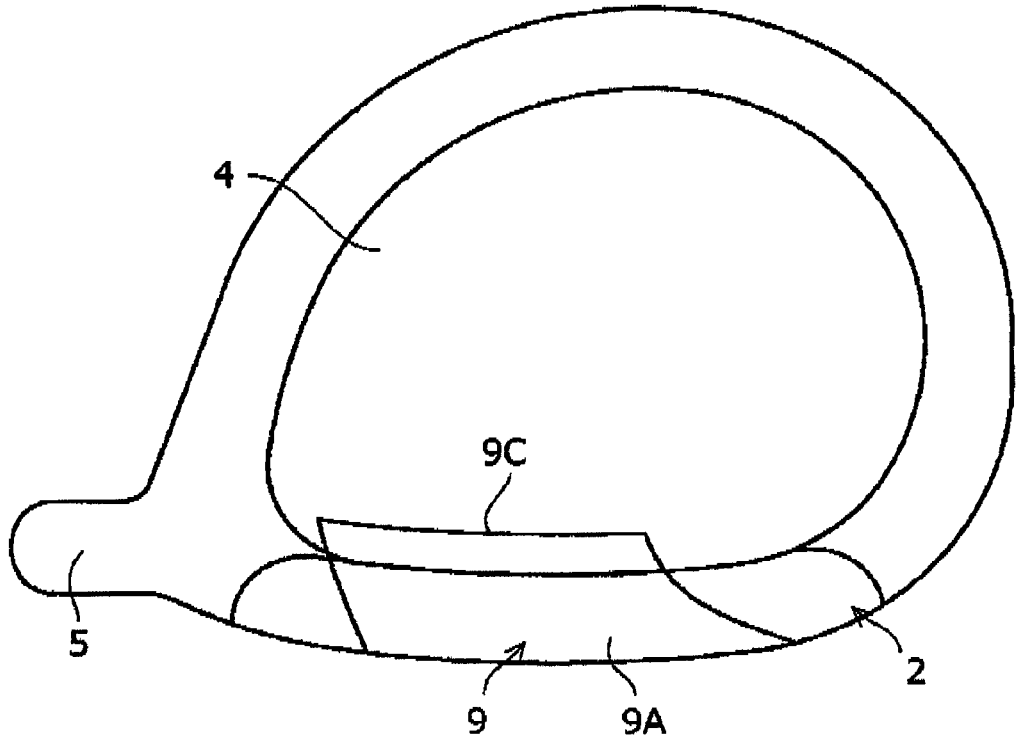
FIG. 2 is a plan view of the golf club head viewed from the sole part side.
Figure 3:
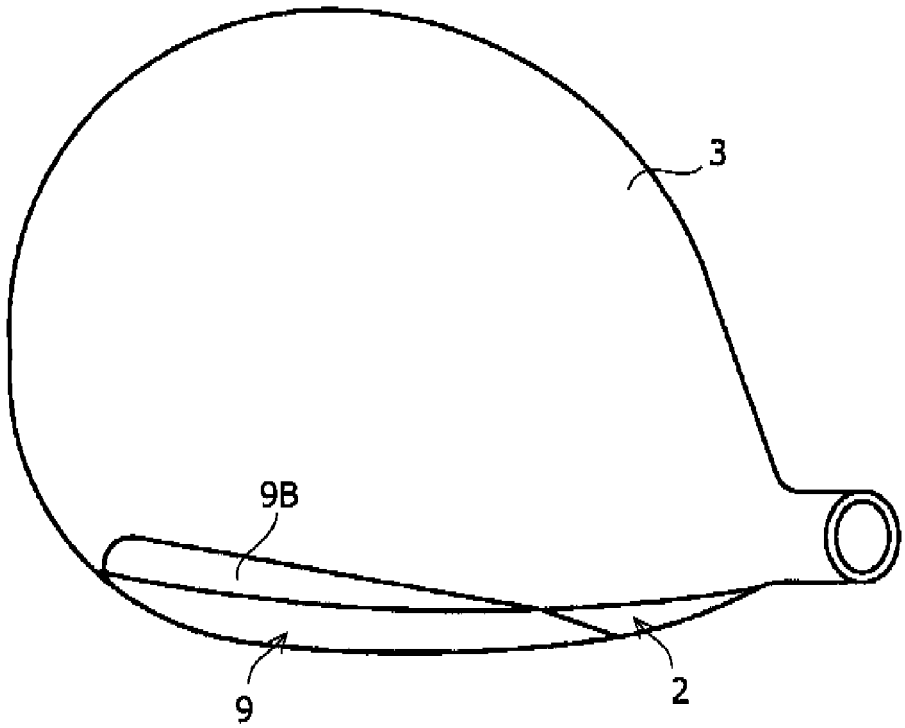
FIG. 3 is a plan view of the golf club head viewed from the crown part side.

The opening 8 is formed between a first part 2*a* on the toe side of the face part 2 and a second part 2*a* on the heel side of the face part 2. The opening 8 connects with a notch part 8A formed in a part on the toe 6 side of the crown part 3 and a notch part 8B formed in a part on the heel 7 side of the sole part 4. As shown in FIGS. 2 and 3, the face plate 9 is formed with an upper extending part 9B and a lower extending part 9C on the upside and downside of a central part 9A forming most of the face part 2 so as to compensate the notch parts 8A and 8B, respectively. As shown in FIG. 3, the width on the toe side of the upper extending part 9B of the face plate 9 is wider than the width on the heel side of the upper extending part 9B of the face plate 9. The face plate 9 is welded to the head body 1.

Figure 4:
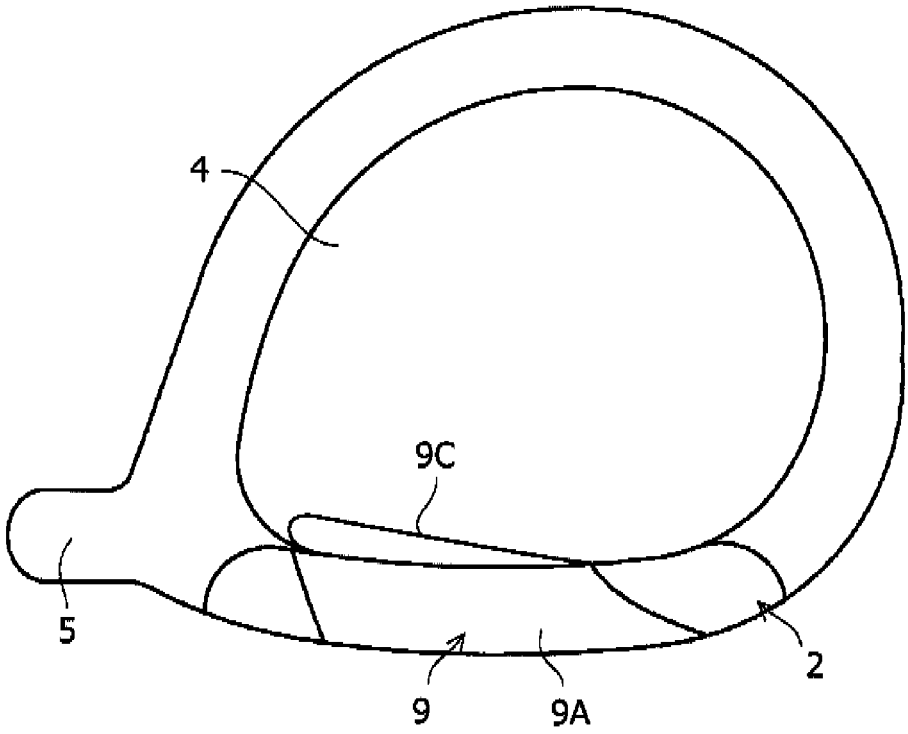
FIG. 4 is a plan view of another embodiment of the club bead viewed from the sole part side.

In another embodiment of the invention, as shown in FIG. 4, the lower extending part 9C of the face plate 9 may be changed in shape. The width on the heel of the lower extending part 9C of the face plate 9 may be wider than the width on the toe side of the lower extending part 9C of the face plate 9.

In recent years, the head body 1 has mainly been formed of a titanium alloy. With the increase in the size of driver heads, the material of the head body 1 has been changed to a material having a high strength in comparison with its low Young's modulus, which is about 60% of that of stainless steel. Therefore, it has been found that the deflection of the face surface increases the initial velocity (delivery velocity) of the ball, and various inventions have been made by many companies. In the present invention as well, the above-described face plate 9 has been devised as the result of a search for a technique for minimizing the decrease in carry for an off-center ball hit, based on the properties of titanium alloy and the data of variations in hit points of golfers.

The head body 1 is made of a titanium alloy. The hosel 5, the face part 2, and the like (excluding the face plate 9) may be formed integrally by forging a round bar of titanium alloy. Alternatively, the hosel 5 may be manufactured separately, and may be connected to the head body 1 by welding. Also, the head body 1 may be manufactured by casting, and the face plate 9 may be manufactured by forging or by pressing a rolled material. Since the face surface is a portion for hitting a golf ball, the face plate 9 is preferably made of a forged material or a rolled material having fine crystals. The use of a metallic material for the face plate 9 having a lower Young's modulus than that of the head body 1 is especially preferable because the rebound of ball is good. For example, the head body 1 is manufactured by forging using a general titanium alloy of Ti-6Al-4V (Young's modulus: about 110 GPa). For the face plate 9, a titanium alloy having a Young's modulus lower than 100 GPa such as Ti-15Mo-3Al may be used.

Figure 5:
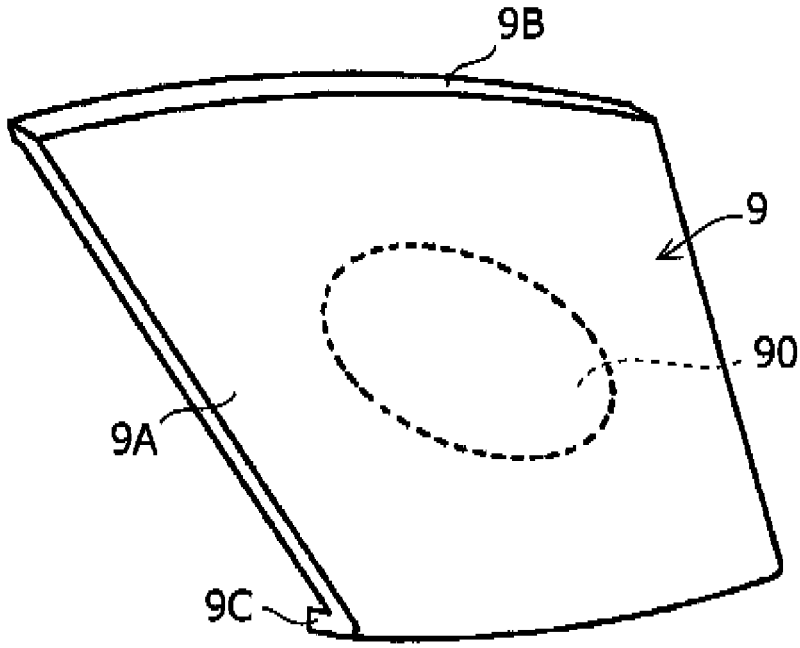
FIG. 5 is a perspective view of the face plate.
Figure 6:
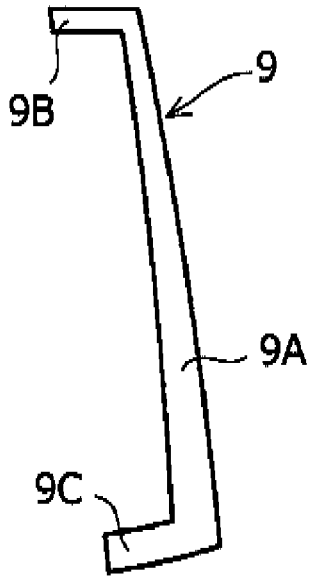
FIG. 6 is a side view of the face plate.
Figure 7:
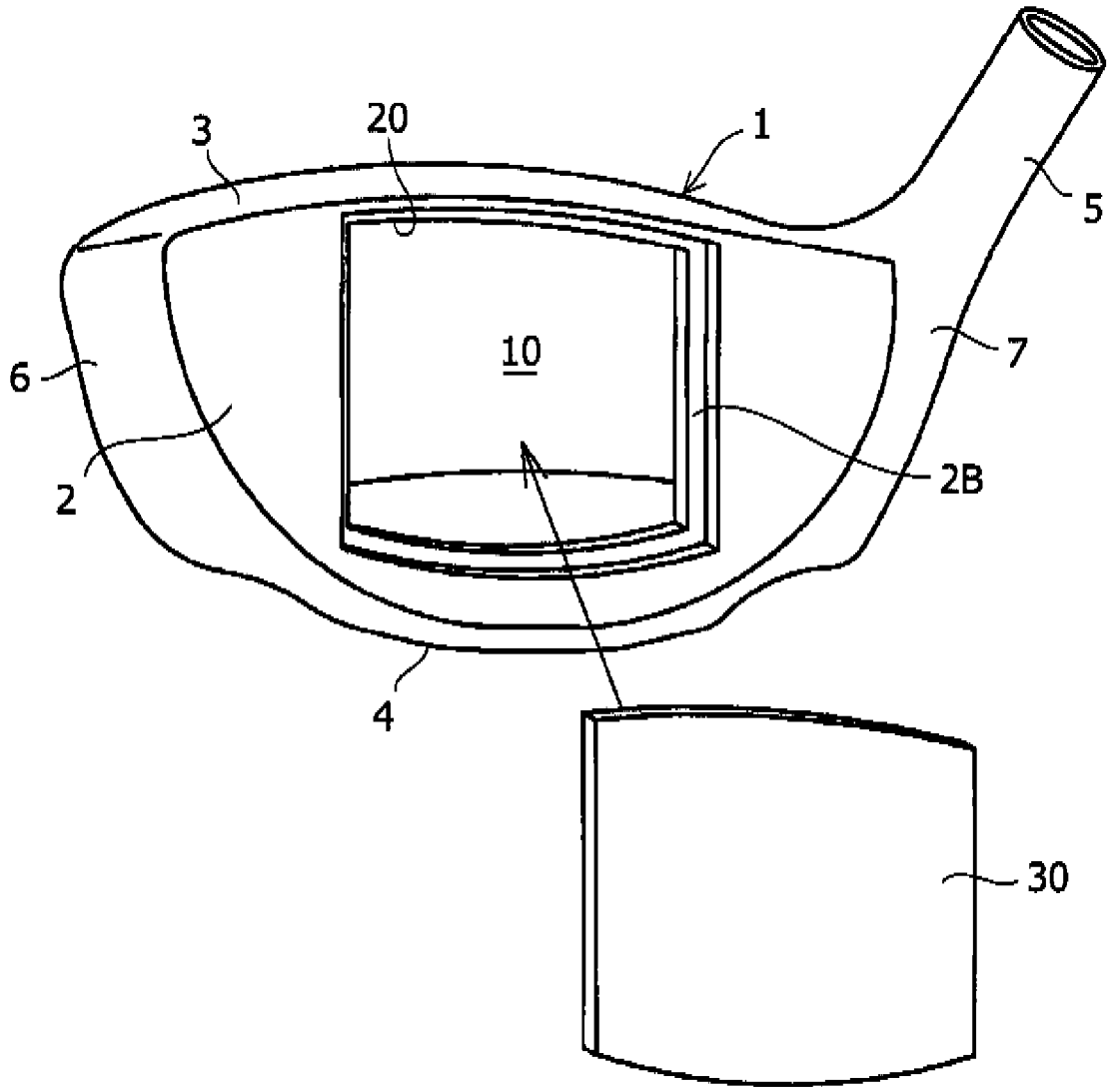
FIG.7 (PRIOR ART)
FIG. 7 is a perspective view showing a conventional example.

For the face plate 9, as shown in FIG. 5, a portion of the face plate 9 corresponding to the central portion (sweet spot) of the face part 2 has a large thickness, and this thick portion forms an elliptical body 90. The major axis of the elliptical body 90 is positioned so as to be high on the toe 6 side and low on the heel 7 side. The variations in hit points of general golfers were examined. As the result, it was found that the golfers tend to hit a ball at the upper portion (the crown part 3 side) on the toe 6 side of the face part 2, and at the lower portion (the sole part 4 side) on the heel 7 side. Therefore, the upper extending part 9B on the crown part 3 side is extended so that the crown part 3 is easily deflected as shown in FIG. 6, by which the rebound of ball is increased. Thereby, the decrease in carry can be made less even for an off-center hit. Therefore, the thickness of the upper extending part 9B in the crown part 3 is preferably 0.5 to 3 mm, especially 0.6 to 1.2 mm. Similarly, the thickness of the lower extending part 9C in the sole part 4 is preferably 0.5 to 3 mm, especially 1.0 to 2.5 mm. Also, the maximum width (the toe-heel direction) of the upper extending part 9B is preferably 5 to 40 mm, especially 10 to 30 mm. Similarly, the maximum width (the toe-heel direction) of the lower extending part 9C is preferably 2 to 30 mm, especially 2 to 15 mm.

The thickness of the face part 2 may be uniform. However, the central portion of face, that is, a particular portion of the face plate 9 can be thick so as to increase the rebound of ball. In particular, considering the variations in ball hit points of golfers, the elliptical thick portion (the elliptical body 90) having the major axis that is high on the toe 6 side and low on the heel 7 side can be provided on the back surface of the face plate 9. The thickness of the elliptical body 90 is preferably 2.5 to 4.0 mm, especially 2.8 to 3.8 mm. The thickness of a thin portion around the elliptical body 90 is preferably 1.5 to 2.5 mm, especially 2.0 to 2.5 mm. Also, the angle of the major axis with respect to the ground or with respect to the shaft axis is preferably 3 to 40°, especially 10 to 30°. The ratio of major axis length to minor axis length is preferably 1:0.2 to 1:0.8, especially 1:0.4 to 1:0.6.

Further, in the contact portion between the notch part 8A, 8B connecting with the opening 8 of the head body 1 and the extending part 9B, 9C of the face plate 9, the thickness of the face plate 9 should be equal to or smaller than the thickness of the opening 8 (the crown part, side part, and sole part) of the head body 1. In particular, a portion around the portion having the maximum width of the extending part 9B, 9C may be thin.

The face plate 9 was manufactured by blanking a rolled material of a β-type titanium alloy (Ti-15Mo-3Al) into an O shape tilting slantwise and by pressing the blanked material. The face plate 9 is thickest near the face center, being 3.4 mm, and becomes thinner stepwise at two stages toward the crown part 3, the side part, and the sole part 4. The thickness of the thinnest peripheral portion is 2.0 mm. The thickness was regulated by acid cleaning (chemical milling). The thick portion in the face center portion has an elliptical shape, and the major axis of the ellipse tilts so as to be high on the toe 6 side of the crown part 3 and low on the heel 7 side of the sole part 4. The tilt angle is 20 degrees so as to correspond to the variations in hit points of golfers. The elliptical shape of the thick portion has a major axis of 18 mm and a minor axis of 9 mm.

The head body 1 was manufactured by an investment casting process using a titanium alloy of Ti-6Al-4V. The opening 8 was formed so that with the ground contact point of the sole part 4 at the time when the lie angle is set at 56 degrees being the reference, the contact point is specified as the central position in the toe-heel direction of the face part 2, and at least the lowest point of the central position includes a lower rim of the opening 8 formed in the face part 2 of the head body 1. The formed face plate 9 is fixed to the opening 8 by welding.

A golf club of a comparative example was manufactured as described below. The head body provided with an opening in the sole part was manufactured by the investment casting process using a titanium alloy of Ti-6Al-4V, the sole part was manufactured by forging in the same way, and the sole part was welded to the head body to manufacture a head. The thickness of the face is uniformly 3.0 mm.

The golf club head in accordance with the embodiment of the present invention manufactured as described above was compared with the golf club head of comparative example by hitting a ball. As the result, in the comparative example, the carry for an off-center hit was shorter than in the case of the present invention.

The invention claimed is:

1. A golf club head in which a face part of a metallic head body having a hollow part therein is formed with an opening communicating with the hollow part, and a metallic face plate is welded to the opening, wherein a notch part connecting with the opening is formed in a part on the toe side of a crown part and a part on the heel side of a sole part, an upper end portion of the face plate is extended so as to compensate the notch part in the crown part and welded to the notch part, and a lower end portion thereof is extended so as to compensate the notch part in the sole part and welded to the notch part, and a width on the toe side of the upper extending part of the face plate is wider than a width on the heel side of the upper extending part, and a width on the heel side of the lower extending part of the face plate is wider than a width on the toe side of the lower extending part.

2. The golf club head according to claim 1, wherein the thickness of the upper end extending part of the face plate is smaller than thickness of the lower end extending part thereof.

3. The golf club head according to claim 1, wherein the thickness of a portion corresponding to the face part of the face plate is larger than the thicknesses of the upper end extending part and the lower end extending part, an elliptical body in which the thickness of a face plate portion corresponding to the central portion of the face part is largest is formed, and the major axis of the elliptical body is positioned so as to be high on the toe side and low on the heel side.

4. The golf club head according to claim 3, wherein the major axis of the elliptical body is positioned at an angle of 10 to 30 degrees relative to a horizontal direction.

5. The golf club head according to claim 4, wherein the major axis of the elliptical body is positioned at an angle of 20 degrees relative to the horizontal direction.

6. The golf club head according to claim 1, wherein the face plate is formed of a material having a Young's modulus lower than that of the head body.

7. The golf club head according to claim 6, wherein the material of the face plate has a Young's modulus lower than 100 GPa.

8. The golf club head according to claim 1, wherein the opening is formed between a first part of the face part disposed at the toe side and a second part of the face part disposed at the heel side.

* * * * *